US010351992B2

(12) United States Patent
Valiyambath Krishnan et al.

(10) Patent No.: US 10,351,992 B2
(45) Date of Patent: Jul. 16, 2019

(54) STEAM IRON HEAD

(71) Applicant: KONINKLIJKE PHILIPS N.V., Eindhoven (NL)

(72) Inventors: Mohankumar Valiyambath Krishnan, Eindhoven (NL); Boon Teck Tan, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 15/522,071

(22) PCT Filed: Oct. 21, 2015

(86) PCT No.: PCT/EP2015/074367

§ 371 (c)(1),
(2) Date: Apr. 26, 2017

(87) PCT Pub. No.: WO2016/066493

PCT Pub. Date: May 6, 2016

(65) Prior Publication Data

US 2017/0314183 A1 Nov. 2, 2017

(30) Foreign Application Priority Data

Oct. 31, 2014 (EP) ..... 14191223

(51) Int. Cl.

| | |
|---|---|
| ***D06F 73/00*** | (2006.01) |
| ***D06F 75/20*** | (2006.01) |
| *D06F 75/12* | (2006.01) |

(52) U.S. Cl.
CPC ..... *D06F 73/00* (2013.01); *D06F 75/20* (2013.01); *D06F 75/12* (2013.01)

(58) Field of Classification Search
CPC ..... D06F 73/00; D06F 75/00
See application file for complete search history.

(56) References Cited

U.S. PATENT DOCUMENTS 1,749,639 A * 3/1930 Leprestre ..... D06F 75/12 38/77.6
2,441,916 A * 5/1948 Busch ..... D06F 75/16 38/77.82

(Continued)

FOREIGN PATENT DOCUMENTS

| | | | |
|---|---|---|---|
| DE | 102004032361 | A1 | 8/2005 |
| EP | 0175848 | A1 | 4/1986 |
| EP | 2251482 | A1 | 11/2010 |

*Primary Examiner* — Ismael Izaguirre

(57) ABSTRACT

The present application relates to a steam iron head (30). The steam iron head (30) has a steam pathway (40) along which steam flows. A cyclonic chamber (61) is along the steam pathway (40). The steam iron head (30) also has a flow inlet (62) to the cyclonic chamber (61), a flow outlet (63) from the cyclonic chamber (61), and a conduit (67) in the cyclonic chamber (61) defining the flow outlet (63). The conduit (67) upstands in the cyclonic chamber (61) and has an opening in a free end (68) of the conduit through which the flow of steam exits the cyclonic chamber (61). The conduit (67) is provided with a rib (91) to restrict the flow of water droplets formed on an outer surface of the conduit from passing through the flow outlet (63). The present application also relates to a steam system iron (10) having a steam iron head (30).

8 Claims, 2 Drawing Sheets

(56) References Cited

U.S. PATENT DOCUMENTS

| | | | | | |
|---|---|---|---|---|---|
| 2,682,719 | A | * | 7/1954 | Cone | D06F 75/14 38/77.4 |
| 2,699,004 | A | * | 1/1955 | Schreyer | D06F 75/16 38/77.4 |
| 2,803,073 | A | * | 8/1957 | Raihle | D06F 75/16 38/77.82 |
| 2,837,847 | A | * | 6/1958 | Franklin | D06F 75/18 38/77.82 |
| 2,853,813 | A | * | 9/1958 | Burreson | D06F 75/16 38/77.8 |
| 3,896,572 | A | * | 7/1975 | Jeffress | D06F 75/18 38/77.83 |
| 7,516,567 | B2 | | 4/2009 | Jiang | |

* cited by examiner

STEAM IRON HEAD

This application is the U.S. National Phase application under 35 U.S.C. § 371 of International Application No. PCT/EP2015/074367, filed on Oct. 21, 2015, which claims the benefit of International Application No. 14191223.89 filed on Oct. 31, 2014. These applications are hereby incorporated by reference herein.

FIELD OF THE INVENTION

The present invention relates to a steam iron head. The present invention also relates to a steam system iron having a steam iron head.

BACKGROUND OF THE INVENTION

Steam irons are used to remove creases from fabric, such as clothing and bedding. Steam system irons typically have a base unit with a steam generator for converting water into steam, a steam iron head from which steam is discharged, for example towards a fabric, and a flexible hose through which steam is fed from the base unit to the steam iron head. The steam iron head typically comprises a body with a handle, so a user can manoeuvre the steam iron, and a soleplate which is placed in contact with the fabric to be ironed. Steam is discharged through steam vents in the soleplate. The soleplate is heated to aid the removal of creases when ironing the fabric.

It is known for steam to sometimes condense when travelling from the steam generator to the steam vents through which steam is discharged, for example when passing through the hose. When this happens, the condensed water may be released from the steam vents, which is a known problem referred to as "spitting". This spitting may create undesired wet spots and staining on a fabric to be treated.

OBJECT AND SUMMARY OF THE INVENTION

It is an object of the invention to provide a steam iron head which substantially alleviates or overcomes the problems mentioned above.

The invention is defined by the independent claims; the dependent claims define advantageous embodiments.

According to one aspect of the present invention, there is provided a steam iron head comprising a steam pathway for the passage of a flow of steam, a cyclonic chamber along the steam pathway, a conduit upstanding in the cyclonic chamber, an opening at a free end of the conduit, the opening forming a flow outlet through which the flow of steam exits the cyclonic chamber, and a barrier on an outer surface of the conduit, wherein the barrier comprises a rib extending circumferentially around the conduit and protruding from the outer surface at the free end of the conduit.

With this arrangement, the barrier prevents droplets of water that would have condensed in the steam pathway or in the hose to climb along the external surface of the conduit under the force exerted by the flow of steam in the cyclonic chamber.

This arrangement thus makes it possible to restrict water droplets from flowing out of the cyclonic chamber through the flow outlet, and so water droplets are restricted from coming into contact with a fabric being treated by the steam iron head.

Water droplets are thus retained in the cyclonic chamber, and so may be heated by a surface of the cyclonic chamber or acted on by a vortex created in the cyclonic chamber.

Furthermore, by providing a cyclonic steam path, any remaining water droplets are centrifugally urged against a peripheral sidewall of the second steam flow section. These may be smaller water droplets formed in the first steam flow section. Water droplets in contact with a surface of the second steam flow section may be evaporated by the heat of the surface.

The barrier may extend around the flow outlet. Therefore, the restriction to water droplets may be maximised, and water droplets are prevented from flowing along the conduit to the flow outlet.

The rib may be a lip extending circumferentially around the flow outlet. A lower side of the rib may extend substantially perpendicular to a longitudinal axis of the conduit. The lower side of the rib may extend substantially at an acute angle to the longitudinal axis of the conduit distending towards the flow inlet. With this arrangement, water droplets and steam flow in the cyclonic chamber proximate to an upper end of the conduit are urged by the rib in a return direction back towards the flow inlet. Therefore, the flow path of steam and water droplets is modified and promotes further evaporation of the water droplets.

At least one groove may be formed on the outer surface of the conduit.

The cyclonic chamber may comprise a base and a peripheral sidewall extending from the base. The conduit may be upstanding from the base. With this arrangement the flow outlet may be spaced above the base, away from the normal flow of water droplets.

The barrier may be annular-shaped. A gap may be provided between outer periphery of the rib and the peripheral wall of the cyclonic chamber. The gap may have an area which is equal to or greater than the flow area of the flow outlet. With this arrangement, excessive velocity of steam passing through the gap is avoided, thereby, avoiding water carryover. The gap may be annular.

The steam pathway may further comprise at least one steam vent through which steam is discharged from the steam iron head and an indirect flow path section, the cyclonic chamber being disposed along the steam pathway between the indirect flow path section and the at least one steam vent.

With this arrangement, it is possible to help maximize the removal of any water droplets, for example formed by condensation, from the steam flow passing to the cyclonic chamber. By providing an indirect steam path, steam passing along the first steam flow section is forced to deviate from the direction of flow. Heavier water droplets in the flow therefore impinge on the surface of the first steam flow section and are distributed as smaller water droplets. These smaller water droplets may be more easily evaporated. Water droplets in contact with a surface of the first steam flow section may be evaporated by the heat of the surface.

The steam head may further comprise a heater configured to heat the cyclonic chamber.

With this arrangement it is possible to easily provide heat to steam in the steam pathway. This provides for surfaces of the steam pathway to be heated such that water droplets coming into contact with the surfaces are evaporated into steam.

According to another aspect of the present invention, there is provided a steam system iron comprising the aforementioned steam iron head.

The steam system iron may further comprise a base unit having a steam generator and a hose fluidly communicating the steam iron head with the steam generator.

These and other aspects of the invention will be apparent from and elucidated with reference to the embodiments described hereinafter.

BRIEF DESCRIPTION OF THE DRAWINGS

Embodiments of the invention will now be described, by way of example only, with reference to the accompanying drawings, in which.

DETAILED DESCRIPTION OF THE EMBODIMENTS

Figure 1:
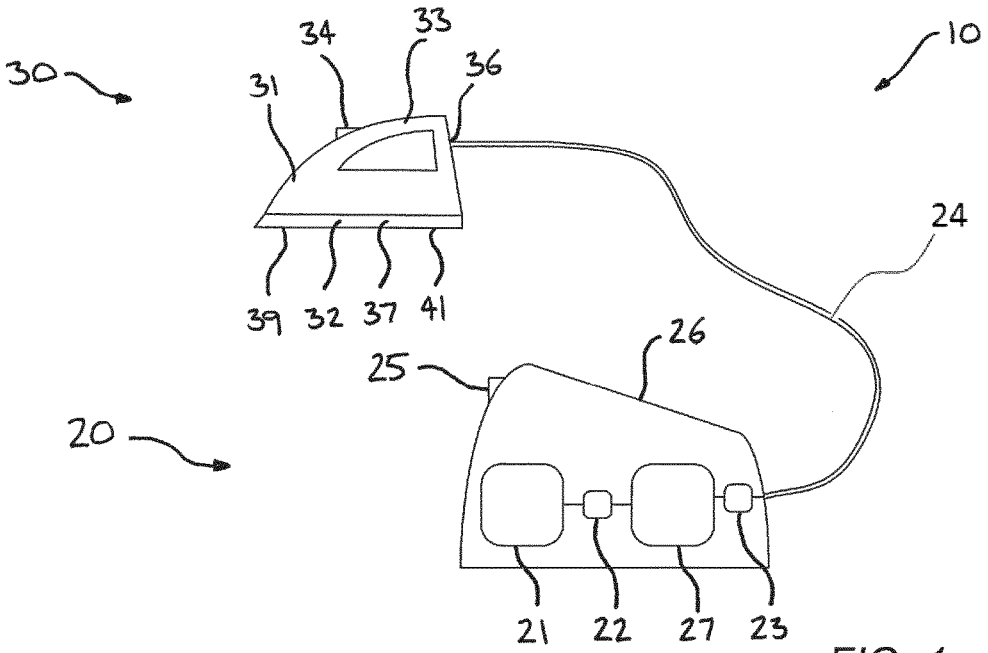
FIG. 1 is a schematic side view of a steam system iron having a steam iron head with a cyclonic chamber according to the present invention.

FIG. 1 depicts a schematic side view of a steam system iron 10 having a steam iron head 30 with a cyclonic chamber, according to the present invention. The steam system iron 10 acts as a steam device. The steam system iron 10 comprises a base unit 20 and a steam iron head 30 according to the present invention. The steam system iron 10 is configured to generate steam to be emitted against a fabric to be treated.

Note although the invention will be described herein by reference to a steam system iron, it will be understood that alternative arrangements are envisaged. For example, the steam device may be a handheld steam iron, a garment steamer or a wallpaper steamer.

The base unit 20 has a steam generator 27. A water reservoir 21 in the base unit 20 holds water to be converted into steam. A pump 22 is provided to supply water from the water reservoir 21 to the steam generator 27. A valve 23 is provided to control the flow of steam from the steam generator 27. The base unit 20 fluidly communicates with the steaming head 30 via a hose 24. The hose 24 is configured to allow the flow of steam from the base unit 20 to the steam iron head 30. The hose 24 communicates with the steam generator 27 via the valve 23. The hose 24 includes a tube (not shown) forming a path along which steam is able to flow. The hose 24 may also include, for example, at least one communication cable (not shown) along which electrical power and/or control signals may be sent between the base unit 20 and the steam iron head 30. The base unit 20 also includes a power supply unit (not shown) for supplying power to components of the steam system iron 10. A base user input 25 is on the base unit 20 for controlling operation of the steam system iron 10. The base unit 20 also has a stand 26 for receiving the steam iron head 30. A controller (not shown) is configured to control operation of the steam system iron 10.

Although the steam generator 27 is in the base unit 20 in the present embodiment, it will be understood that the arrangement of the base unit 20 may differ. For example, the steam generator 27 may be in the steam iron head 30. In such an arrangement, the hose 24 may supply water from the base unit 20 to the steam iron head 30. Alternatively, the water reservoir 21 may be in the steam iron head 30, and the base unit 20 omitted.

The steam iron head 30 according to the invention has a body 31 and a soleplate 32. The soleplate 32 defines a lower end of the steam iron head 30. The body 31 comprises a handle 33 that enables a user to hold and manoeuvre the steam iron head 30. A user input 34 is on the body 31 for operating the steam system iron 10. Steam is provided to the steam iron head 30 via the hose 24. The steam iron head 30 comprises a steam inlet 36 through which steam is supplied to the steam iron head 30. The supply of steam to the steam iron head 30 is controlled by the base unit 20, however, it will be understood that the steam iron head 30 may have a steam feed unit to control the mass-flow of steam from the steam iron head 30.

Figure 4:
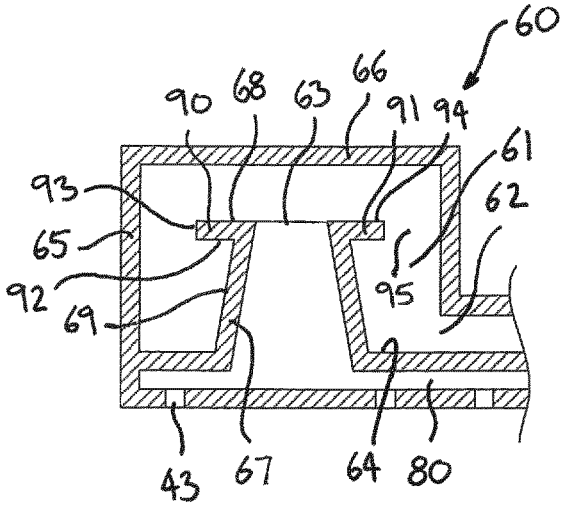
FIG. 4 is a schematic cross-sectional view of the cyclonic chamber according to the present invention.

The steam iron head 30 has steam vents 43 (refer to FIG. 4) through which steam flows from the steam iron head 30 to be provided to a fabric, for example. The steam vents 43 are in the soleplate 32. A steam pathway 40 (refer to FIG. 2) is defined from the steam inlet 36 to the steam vents 43. The soleplate 32 has a soleplate panel 37. The soleplate panel 37 defines the steam pathway 40. The soleplate panel 37 has a main body 38 (refer to FIG. 2). The soleplate panel 37 also has an ironing plate 39. The ironing plate 39 defines a fabric contact surface 41. The steam vents 43 extend through the ironing plate 39. The fabric contact surface 41 is configured to be positioned against a fabric to be treated. The steam vents 43 are formed to open to the steam contact surface 41. The fabric contact surface 41 is planar.

The ironing plate 39, defining a lower side of the soleplate panel 37 defines the fabric contact surface 41. The soleplate panel 37 is formed from a heat conductive material, for example aluminium. The soleplate panel 37 is formed from a plurality of layers, for example in the present embodiment the main body 38 and ironing plate 39 are mounted together, and the ironing plate 39 has a non-stick layer (not shown). The soleplate panel 37 may be formed from a single layer. The soleplate panel 37 has at least one chamber or pathway defined therein. It will be understood that the number of steam vents 43 may vary. One steam vent 43 may be present, or a plurality of steam vents 43 may be distributed along the fabric contact surface 41. The soleplate 32 also has a cover 42 (refer to FIG. 3). The cover 42 defines an upper end of the soleplate 32. The cover 42 is mounted to the main body 38 of the soleplate panel 37. It will be understood that the soleplate panel 37 and cover 42 may be integrally formed.

A heater 35 (refer to FIG. 2) is received in the soleplate panel 37. In the present embodiment, the heater 35 is embedded in the main body 38. The heater 35 extends longitudinally along the soleplate panel 37. The heater 35 has a U-shaped arrangement with the apex of the heater 35 disposed proximal to a front end of the steam iron head 30. The heater 35 is substantially internally received in the soleplate panel 37. The heater 35 conducts heat to the soleplate panel 37, when operated. It will be understood that the arrangement of the heater 35 may differ.

Figure 2:
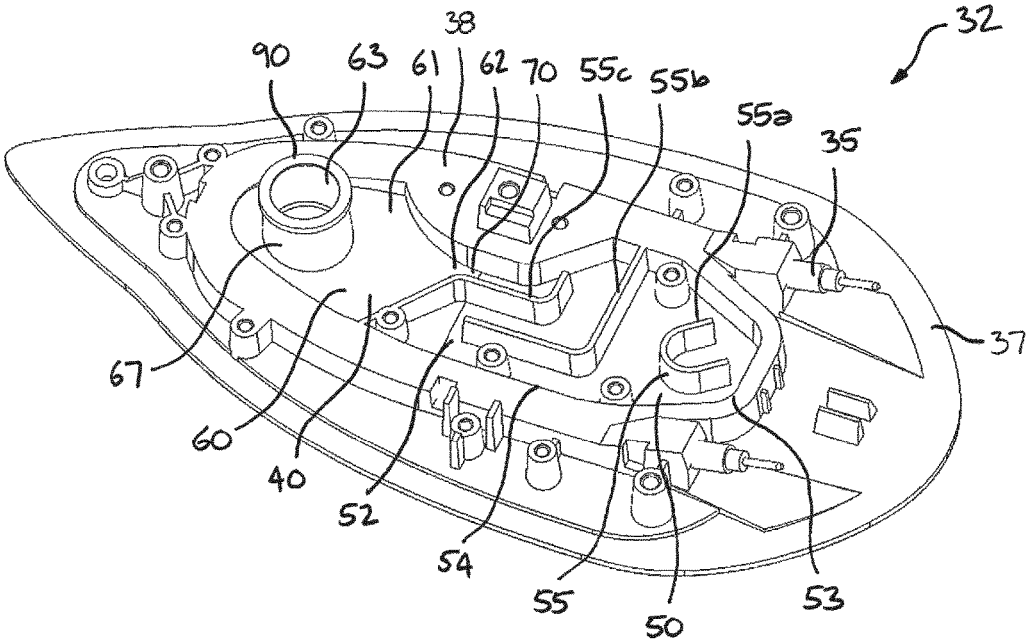
FIG. 2 is a diagrammatic perspective view of a soleplate of the steam iron head shown in FIG. 1 with a cover of the soleplate omitted according to the present invention.
Figure 3:
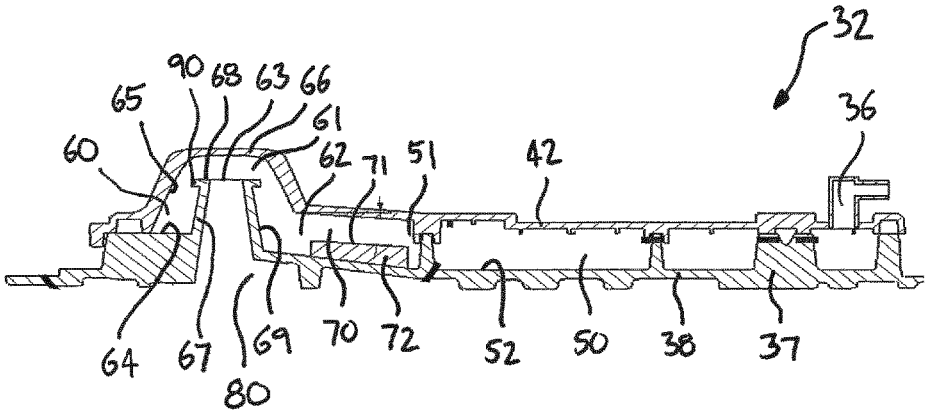
FIG. 3 is a diagrammatic cut-away side view of the soleplate shown in FIG. 2 with the cover included according to the present invention.

Referring to FIGS. 2 and 3, the soleplate 32 of the steam iron head 30 is shown. FIG. 2 shows the soleplate 32 of the steam iron head 30 with the cover 42 omitted. The soleplate 32 defines the steam pathway 40. The steam pathway 40 extends from the steam inlet 36 to the steam vents 43. Therefore, steam flows into the steam iron head 30 through the steam inlet 36, flows along the steam pathway 40 and flows from the steam iron head 30 through the steam vents 43. The soleplate 32 is formed from, for example, but not limited to aluminium or magnesium alloys.

The steam pathway 40 comprises a first steam flow section 50 and a second steam flow section 60. The first steam flow section 50 is defined between the steam inlet 36 and the second steam flow section 60. The second steam flow section 60 is defined between the first steam flow section 50 and the steam vents 43. A linking passage 70, acting as an intermediate steam flow section, communicates between the first steam flow section 50 and the second steam flow section 60. The linking passage 70 may be omitted. An outlet passage 80, acting as an outlet steam flow section, communicates between the second steam flow section 60 and the steam vents 43. The outlet passage 80 may be omitted.

The steam inlet 36 comprises a pipe. The steam inlet 36 fluidly communicates with the hose 24, such that steam flowing along the hose 24 is provided to the steam inlet 36. The steam inlet 36 communicates with the first steam flow section 50 of the steam pathway 40. The steam inlet 36 communicates with the first steam flow section 50 at one end of a steam path defined by the first steam flow section 50. A first steam flow section outlet 51 is at the other end of the steam path defined by the first steam flow section 50.

The first steam flow section 50 comprises a base wall 52 and sidewalls 53. The sidewalls 53 comprise an outer sidewall 54 and internal sidewalls 55. The internal sidewalls 55 act as baffles to direct the fluid flow through the first steam flow section 50. Three internal sidewalls 55, a first sidewall 55*a*, second sidewall 55*b*, and third sidewall 55*c*, are shown in FIG. 2, although it will be understood that the number and configuration of the internal sidewalls 55 may vary dependent on the desired flow path through the first steam flow section 50.

The outer sidewall 54 defines the maximum extent of the first steam flow section 50 and forms a flow chamber through which steam is able to flow. The outer sidewall 54 acts as a baffle to direct the fluid flow through the first steam flow section 50. It will be understood that the configuration of the outer sidewall 54 may vary dependent on the desired flow path through the first steam flow section 50.

The outer sidewall 54 extends from the base wall 52. The base wall 52 and outer sidewall 54 are formed by the main body 38 of the soleplate panel 37. The internal sidewalls 55 extend from the base wall 52. The internal sidewalls 55 are formed by the main body 38 of the soleplate panel 37. In the present embodiment, the sidewalls 53 are integrally formed with the soleplate panel 37. However it will be understood that the configuration may vary. The sidewalls 53 extend from the base wall 52 to help maximise heat conduction to the sidewalls 53 from the heater 35. This helps to ensure that the sidewalls 53 are heated.

The base wall 52 and sidewalls 53 form steam contact walls of the first steam flow section 50. The corresponding part of the cover 42 also forms a steam contact wall of the first steam flow section 50. Surfaces of the base wall 52 and sidewalls 53 form steam contact surfaces. The corresponding part of the cover 42 also forms a steam contact surface.

In the present embodiment, steam flows into the first steam flow section 50 of the steam pathway 40 via the steam inlet 36. Steam flows from the first steam flow section 50 through the first steam flow section outlet 51. In the present embodiment, the first steam flow section outlet 51 is formed in the outer sidewall 54. The first steam flow section outlet 51 is spaced from the steam inlet 36. The sidewalls 53 direct the fluid flow from the steam inlet 36 to the first steam flow section outlet 51.

The flow path defined in the first steam flow section 50 of the steam pathway 40 is an indirect flow path. That is, fluid flowing along the flow path must change direction at least once as it passes along the flow path. This helps cause a collision of fluid flowing along the flow path with at least one sidewall 53. Therefore, the first steam flow section 50 acts as an indirect flow path section. In the present embodiment, the flow path defined in the first steam flow section 50 has a labyrinth configuration. That is, fluid flowing along the flow path must make multiple changes in direction as it flows along the flow path from the steam inlet 36 to the first steam flow section outlet 51. This helps cause multiple collisions of fluid flowing along the flow path with sidewalls 53. The internal sidewalls 55, acting as baffles, direct the flow of steam through the first steam flow section 50.

The first internal sidewall 55*a* extends partially around the steam inlet 36. The steam inlet 36 communicates through the cover 42, although alternative arrangements are possible. The first internal sidewall 55*a* is U-shaped. The first internal sidewall 55*a* forms a multicursal arrangement, that is forming multiple flow branches in the first steam flow section 50. The second internal sidewall 55*b* is L-shaped. The second internal sidewall 55*b* forms a unicursal arrangement, that is forming a single flow branch in the first steam flow section 50. The third internal sidewall 55*c* is also L-shaped. The third internal sidewall 55*c* extends to the first steam flow section outlet 51.

The arrangement of the first steam flow section 50 may vary. The first steam flow section 50 causes multiple changes in direction to fluid flowing along the flow path. By providing an indirect steam path, the direction of flow of steam passing along the first steam flow section is forced to deviate. Heavier water droplets in the flow are more resistant to deviations in flow direction and therefore impinge against the sidewalls 53 of the first steam flow section 50 and are dispersed as smaller water droplets. These smaller water droplets may be more easily evaporated. Water droplets in contact with a surface of the sidewalls 53 of the first steam flow section 50 may be evaporated by the heat of the surface.

More specifically, the steam iron head 30 according to the invention comprises the following sub-set of features:

- the steam pathway 40 for the passage of a flow of steam as previously described,
- a cyclonic chamber 61 along the steam pathway 40,
- a conduit 67 upstanding in the cyclonic chamber 61,
- an opening at a free end 68 of the conduit 67, the opening forming a flow outlet 63 through which the flow of steam exits the cyclonic chamber 61, and
- a barrier 90 on an outer surface 69 of the conduit 67.

The second steam flow section 60 comprises the cyclonic chamber 61. The cyclonic chamber 61 acts as a fluid separator. The cyclonic chamber 61 has a flow inlet 62 and a flow outlet 63. Steam from the first steam flow section 50 flows into the cyclonic chamber 61 through the flow inlet 62. The flow inlet 62 communicates with the linking passage 70.

The linking passage 70, acting as an intermediate steam flow section, communicates between the first steam flow section 50 and the second steam flow section 60. The linking passage 70 extends from the first steam flow section outlet 51 and the flow inlet 62. The linking passage 70 has a linking passage base 71. The linking passage base 71 is defined by a stepped portion 72. The stepped portion 72 is stepped from the base wall 52 of the first steam flow section 50. Therefore, the flow area of the linking passage 70 is less than the flow area of the first steam flow section 50. It will be understood that the reduction in flow area may be achieved by alternative arrangements. The reduction in flow area at the linking passage 70 causes a restriction at the flow inlet 62. The restriction increases the velocity of steam flow. The linking passage 70 is inclined relative to the first steam flow section 50. The linking passage base 71 is inclined relative to the base wall 52 of the first steam flow section 50. In the present embodiment, the incline is about 5 degrees. The incline causes the steam flow entering the cyclonic chamber 60 to follow a helical path. The steam flow therefore enters the cyclonic chamber at a non-perpendicular angle to the longitudinal axis of the cyclonic chamber 61.

The cyclonic chamber 61 has a base 64 and a peripheral sidewall 65. The peripheral sidewall 65 extends from the base 64. The peripheral sidewall 65 converges from the base 64. The cyclonic chamber 61 forms a substantially frusto-conical shape. A top wall 66 of the cyclonic chamber 61 faces the base 64. The flow inlet 62 is disposed proximate to a lower end of the cyclonic chamber 61. The flow inlet 62 is formed at the peripheral sidewall 65. The flow inlet 62 is configured to guide steam flow to enter the cyclonic chamber 60 tangentially. In the present embodiment, the peripheral sidewall 65 and top wall 66 are formed by the cover 42. The surfaces of the cyclonic chamber 61 are heated by heat conducted through the soleplate 32 from the heater 35.

The flow outlet 63 is disposed proximate to an upper end of the cyclonic chamber 61. The conduit 67 extends upwards in the cyclonic chamber 61. In the present embodiment, the conduit 67 is a tubular structure. The conduit 67 upstands in the cyclonic chamber 61 and extends from the base 64. The conduit 67 defines a flow path from the flow outlet 63. This arrangement provides for steam exiting from the cyclonic chamber 61 to be simply supplied to the steam vents 43. The conduit 67 extends along the longitudinal axis of the cyclonic chamber 61. A free end 68 of the conduit 67 is proximate to the upper end of the cyclonic chamber 61. The conduit 67 has an outer surface 69 facing into the cyclonic chamber 61. That is, the surface of the conduit 67 facing the peripheral sidewall 65 of the cyclonic chamber 61. In the present arrangement the conduit 67 is cylindrical. That is, the outer surface 69 of the conduit 67 is cylindrical. However, it will be understood that the conduit 67 may converge towards the free end 68, or have an alternative configuration. The conduit 67 is heated by heat conducted from the heater 35.

The conduit 67 has an opening at its free end 68. The opening forms the flow outlet 63. In the present embodiment, the flow outlet 63 forms the end of the conduit 67, however it will be understood that the flow outlet 63 may be formed by at least one opening in the outer surface 69 of the conduit 67 proximate to or at the free end 68. The opening is circular. The flow outlet 63 defines a path through the conduit 67. The flow outlet 63 is in communication with the outlet passage 80, acting as an outlet steam flow section. The outlet passage 80 communicates between the second steam flow section 60 and the steam vents 43.

The outlet passage 80 is formed by the soleplate 32. The outlet passage 80 is defined between the main body 38 and the ironing plate 39 of the soleplate panel 37. Therefore, steam flow from the second steam flow section 60 is simply provided to the steam vents 43. Furthermore, the outlet passage 80 is heated.

The cyclone chamber 61 acts as a fluid separator. The cyclone chamber 61 is configured to separate any water droplets, for example condensation, from steam flow by centrifugal force. Centrifugal force is caused by the inertia of a body; its resistance to change in its direction of motion. By providing a cyclonic steam path, any remaining water droplets are centrifugally urged against a peripheral sidewall of the second steam flow section. These may be smaller water droplets formed in the first steam flow section 50. Water droplets in contact with a surface of the cyclone chamber 61 may be evaporated by the heat of the surface. Dry steam, that is steam from which water droplets are at least substantially absent, is then able to flow through the flow outlet 63.

The barrier 90 may advantageously take the form of a protruding structure 90 protruding from the outer surface 69.

For example, the barrier 90 corresponds to a rib 91 protruding into the cyclonic chamber 61. The rib 91 extends circumferentially around the conduit 67. The rib 91 extends around the flow outlet 63. The rib 91 extends at the free end 68 of the conduit 67. The rib 91 may, for example, take the form of a lip extending in the cyclonic chamber 61 at the flow outlet 63. A lower side 92 of the rib 91 extends perpendicular to a longitudinal axis of the conduit 67. The lip formed by the rib 91 is annular. A rib edge 93 defines a peripheral edge of the rib 91. The rib 91 is ring-shaped, although alternative shapes are envisaged. The lower side 92 of the rib 91 is planar. An upper side 94 of the rib 91 is planar. The rib 91 is liquid impermeable and allows to restrict liquid water reaching the flow outlet 63 and exit together with the flow of steam, in particular droplets of water that would have condensed in the steam pathway 40 or in the hose 24 to climb along the external surface of the conduit under the force exerted by the flow of steam in the cyclonic chamber. The rib 91 forms a flange extending from the outer surface 69 of the conduit 67. The rib 91 is spaced from the peripheral sidewall 65. A gap 95 is provided between the outer periphery of the protruding structure 90 and the peripheral sidewall 65 of the cyclonic chamber 61. The gap 95 in the present arrangement has an area that is equal to or greater than the flow area of the flow outlet 63. The gap 95 is an annular gap. This helps avoid development of excessive steam velocity passing through the gap 95 and thereby prevents water carryover.

Although in the present embodiments the cyclonic chamber 61 is described as the second steam flow section 60 of the steam pathway 40, it will be understood that the arrangement of the steam pathway 40 may vary. Therefore, the cyclonic chamber 61 as described above may form part of a steam pathway having a different arrangement. For example, the first steam flow section 50 may be omitted.

Use of the steam system iron 10 will now be described with reference to FIGS. 1 to 5. The user actuates the steam system iron 10 by operating the base user input 25. Water is fed to the steam generator 27 from the water reservoir 21 by the pump 22. The steam generator 27 is operated to evaporate the water into steam under pressure. The flow of steam from the steam generator 27 is controlled by the valve 23. The valve 23 is operable by the user input 34 on the steam iron head 30 so that a user is able to control the flow of steam through the steam vents 43. It will be understood that the valve 23 may be omitted, or steam flow may be controlled in an alternative manner.

The user is able to hold the steam iron head 30 and manoeuvre the steam iron head 30 to a desired operating position, for example against a fabric to be treated. The hose 24 is flexible to allow movement of the steam iron head 24 relative to the base unit 20. When the valve 23 is opened, steam flows along the hose 24 to the steam iron head 30.

Steam flows to the steam inlet 36. Steam may condense as it flows along the hose 24 so that water droplets are carried along with the steam flow.

Steam enters the steam pathway 40 through the steam inlet 36. The steam then flows into the first steam flow section 50 of the steam pathway 40. The steam flows in the first steam flow section 50 along an indirect flow path. The sidewalls 53 direct the fluid flow from the steam inlet 36 to the first steam flow section outlet 51. The indirect path defined in the first steam flow section 50 causes collision of fluid flowing along the flow path with at least one sidewall 53. As the steam flows along the steam path defined in the first steam flow section 50, the steam flow is forced to change direction. The lighter steam particles tend to change direction easier than heavier water droplets in the steam flow. The heavier water droplets therefore collide with the sidewalls 53. Water droplets impinge against the sidewalls 53 of the first steam flow section 50 and such water droplets are dispersed as smaller water droplets. Heat is also transferred to water droplets by the surface of the sidewalls 53 and so water droplets evaporate and rejoin the steam flow. The labyrinth configuration of the first steam flow section 50 helps cause multiple collisions of fluid flowing along the flow path with sidewalls 53.

Once steam has passed along the first steam flow section 50, the steam flows through the first steam flow section outlet 51 into the linking passage 70. The flow area of the linking passage 70 is less than the flow area of the first steam flow section 50. Therefore, the steam flow velocity is increased. The steam flow passes into the second steam flow section outlet 52 through the flow inlet 62. The steam flow enters into the cyclonic chamber 61 tangentially. That is, the flow of the fluid is tangential to the peripheral sidewall 65. The steam also enters at an inclined path due to the incline of the linking passage 70. The increased velocity of the steam flow entering the cyclonic chamber 61 maximises the centrifugal force acting on the flow.

The fluid entering the cyclonic chamber 61 is a mixture of steam and any remaining water droplets that were not fully evaporated in the first steam flow section 50. The flow inlet 62 introduces the fluid flow into the cyclonic chamber 61 through the peripheral sidewall 65. Therefore, fluid flow is required to change direction when it enters the cyclonic chamber 61 due to the frusto-conical arrangement of the cyclonic chamber 61.

As the fluid changes direction it resists the change to its state of motion. Particles with a larger mass, such as water droplets, resist the change to their state of motion more than particles with a smaller mass, such as steam particles. Therefore, the heavier water droplets resist the change in direction of the flow of the fluid more than the lighter steam particles. Consequently, the heavier water droplets move radially outwardly into contact with the peripheral sidewall 65 of the cyclonic chamber 61. Therefore, water droplets in the steam flow are urged away from flow outlet 63 and so will not reach the steam vents 43. When water droplets come into contact with the peripheral sidewall 65, heat is transferred from the heated peripheral sidewall 65 therefore causing the water droplets to evaporate. This helps minimise water droplets in the steam flow. Furthermore, any water droplets that flow to the base 64 of the cyclonic chamber 61 due to gravity flow away from the flow outlet 63 and may be evaporated by the heated base 64.

The steam flow passes in a helical manner around the cyclonic chamber 61 and flows towards the upper end of the cyclonic chamber 61. The steam flow is then able to pass through the flow outlet 63 to flow to the steam vents 43. Some water droplets in the cyclonic chamber 61 may adhere to and collate on the outer surface 69 of the conduit 67. These water droplets may be urged upwardly by the vortex flow in the cyclonic chamber 61 which flows between the flow inlet 62 and the flow outlet 63. Such water droplets on the outer surface 69 of the conduit 67 are therefore urged to flow towards the flow outlet 63. Should these droplets reach the flow outlet 63 then they would pass though the flow outlet 63 and may be discharged through the steam vents 43 and into contact with a fabric to be treated.

With the present embodiments, any water droplets on the outer surface 69 of the conduit 67 are prevented from reaching the flow outlet 63 by the rib 91, to restrict the flow of water droplets along the conduit 67 to the flow outlet 63. Any water droplets flowing along the outer surface 69 of the conduit 67 will flow into contact with the lower side 92 of the rib 91 and so further upward flow is prevented. Furthermore, any water droplets that are in contact with the lower side 92 of the rib 91 are urged radially inwardly along the lower side 92 of the rib 91 back towards the conduit 67 due to the flow pattern created in the cyclonic chamber 61. Therefore, water droplets are restricted from flowing along the lower side 92 of the rib 91 to the rib edge 93.

Due to the conduit 67 being heated by heat energy conducted from the heater 35, any water droplets in contact with the conduit 67 are heated by heat transfer from the outer surface 69 of the conduit 67. Therefore, such water droplets may be evaporated and so enter the steam flow as steam.

The circumferentially extending rib 91 in the cyclonic chamber 61 modifies the flow pattern of the vortex flow in the cyclonic chamber 61 proximate to the conduit 67. With the rib 91 protruding into the cyclonic chamber 61, the rate of flow towards the upper end of the cyclonic chamber 61 is reduced proximate to the conduit 67. Therefore, the flow rate of water droplets along the outer surface 69 of the conduit 67 is minimised. With such an arrangement heat transfer from the conduit 67 to water droplets adhered to the conduit 67 is increased and so the rate of evaporation of water droplets is therefore maximised.

Steam passing through the flow outlet 63 is generally dry steam, that is steam without water droplets carried therewith due to the combined effects of the first and second steam flow sections 50, 60. The combination of the indirect path of the first steam flow section 50 and the cyclonic path of the second steam flow section 60 has a synergistic effect of removing water droplets from a steam flow passing along the steam pathway 40 from the steam inlet 36 to the steam vents 43. The first steam flow section 50 breaks down larger water droplets, and that the second steam flow section 60 helps to ensure evaporation of any remaining water droplets. The steam is known as dry steam because all the water is in a gaseous state. That is, there is a minimal amount of water droplets present in the fluid.

Steam passing through the flow outlet 63 then flows to the steam vents 43 via the outlet passage 80. It will be understood that the outlet passage 80 is heated by the heater 35 and so the steam flowing therealong is restricted from condensing.

The dry steam, with minimal or no water droplets, is then discharged through the steam vents 43 and onto the fabric to be treated. The user manoeuvres the steam iron head 30 across the fabric to distribute the steam and remove wrinkles.

Figure 5:
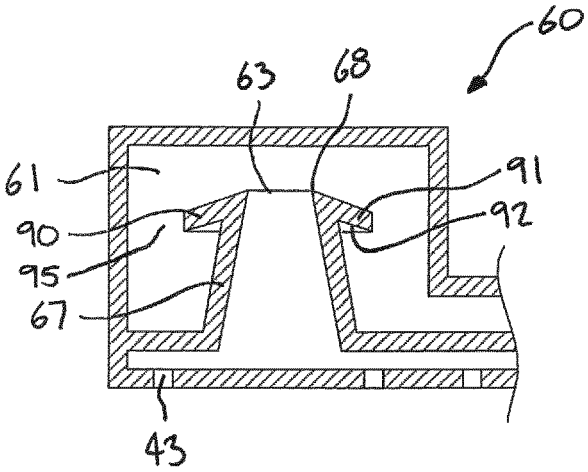
FIG. 5 is a schematic cross-sectional view of an alternative arrangement of the cyclonic chamber according to the present invention.

In the above described embodiments the lower side 92 of the rib 91, acting as barrier, extends perpendicular to the longitudinal axis of the conduit 67. However, it will be understood that the angle of orientation of the lower side 92 of the rib 91 may vary, and may extend transverse to the longitudinal axis of the conduit 67. An alternative embodiment is shown in FIG. 5. In this embodiment, the circumferentially extending rib 91 protrudes from the conduit 67 at an acute angle to the longitudinal axis of the conduit 67 distending towards the flow inlet 62. With this arrangement, water droplets and steam flow in the cyclonic chamber 61 proximate to the upper end of the conduit 67 are urged by the rib 91 in a return direction back towards the flow inlet 62. Therefore, the flow path of steam and water droplets is modified and promotes further evaporation of the water droplets.

Although in the present arrangement the rib 91 is a formed as a lip at the upper edge of the conduit 67, it will be understood that alternative arrangements are possible. For example, the rib 91 may be spaced from the upper edge of the free end 68 of the conduit 67.

Although in the present embodiments, the barrier 90 is made of a single element, a barrier 90 may comprise a plurality of elements, such as a plurality of ribs as previously described.

The barrier 90 is integrally formed with the conduit 67 in the above described embodiments; however it will be understood that the barrier 90 may be a separate component which is mountable to the conduit 67.

Although in the present arrangement the protruding structure 90 is the circumferentially extending rib 91 protruding into the cyclonic chamber 61, it will be understood that alternative arrangements are possible. Such arrangements restrict the flow of water droplets in the cyclonic chamber 61 to the flow outlet 63. For example, in one embodiment the barrier 90 comprises a recess, such as a groove (not shown). The groove is formed in the outer surface of the conduit. The groove may be an annular groove. In such an embodiment, the groove is disposed proximate to the flow outlet. In other embodiments, the barrier comprises at least two grooves, or a combination of at least one protruding structure, such as a rib, and at least one recess, such as a groove.

It will be appreciated that the term "comprising" does not exclude other elements or steps and that the indefinite article "a" or "an" does not exclude a plurality. A single processor may fulfil the functions of several items recited in the claims. The mere fact that certain measures are recited in mutually different dependent claims does not indicate that a combination of these measures cannot be used to an advantage. Any reference signs in the claims should not be construed as limiting the scope of the claims.

Although claims have been formulated in this application to particular combinations of features, it should be understood that the scope of the disclosure of the present invention also includes any novel features or any novel combinations of features disclosed herein either explicitly or implicitly or any generalisation thereof, whether or not it relates to the same invention as presently claimed in any claim and whether or not it mitigates any or all of the same technical problems as does the parent invention. The applicants hereby give notice that new claims may be formulated to such features and/or combinations of features during the prosecution of the present application or of any further application derived therefrom.

The invention claimed is:

1. A steam iron head comprising:

a steam pathway for the passage of a flow of steam, a cyclonic chamber defining a helical flow path of the flow of steam along the steam pathway between a flow inlet of the cyclonic chamber and a flow outlet of the cyclonic chamber, a conduit upstanding in the cyclonic chamber, an opening at a free end of the conduit, the opening forming the flow outlet through which the flow of steam exits the cyclonic chamber, and a barrier on an outer surface of the conduit, wherein the barrier includes a rib extending circumferentially around the conduit and protruding from the outer surface at the free end of the conduit.

2. The steam iron head according to claim 1, wherein the rib is a lip extending circumferentially around the conduit.

3. The steam iron head according to claim 1, wherein a lower side of the rib extends substantially perpendicular to a longitudinal axis of the conduit.

4. The steam iron head according to claim 1, wherein a lower side of the rib extends at an acute angle to the longitudinal axis of the conduit.

5. The steam iron head according to claim 2, wherein the barrier further includes at least one groove formed in the outer surface of the conduit.

6. The steam iron head according to claim 1, wherein the barrier is annular-shaped.

7. The steam iron head according to claim 2, wherein a gap is provided between the outer periphery of the rib and the peripheral sidewall of the cyclonic chamber, the gap being equal to or greater than the flow area of the flow outlet.

8. A steam system iron comprising the steam iron head according to claim 1.

* * * * *